US009623665B2

(12) United States Patent
Aoki et al.

(10) Patent No.: US 9,623,665 B2
(45) Date of Patent: Apr. 18, 2017

(54) LIQUID CONTAINER

(71) Applicant: Seiko Epson Corporation, Tokyo (JP)

(72) Inventors: Yuji Aoki, Hara-mura (JP); Naoki Naito, Matsumoto (JP); Takeshi Iwamuro, Matsumoto (JP); Ryoji Fujimori, Suwa (JP); Keiichiro Yoshino, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/000,263

(22) Filed: Jan. 19, 2016

(65) Prior Publication Data

US 2016/0221349 A1 Aug. 4, 2016

(30) Foreign Application Priority Data

Feb. 4, 2015 (JP) ..... 2015-020013

(51) Int. Cl.
*B41J 2/175* (2006.01)

(52) U.S. Cl.
CPC ..... *B41J 2/17513* (2013.01); *B41J 2/175* (2013.01); *B41J 2/1752* (2013.01); *B41J 2/1753* (2013.01); *B41J 2/17546* (2013.01); *B41J 2/17553* (2013.01)

(58) Field of Classification Search
CPC B41J 2/17513; B41J 2/17553; B41J 2/17556; B41J 2/17516
See application file for complete search history.

(56) References Cited

U.S. PATENT DOCUMENTS 4,551,734 A * 11/1985 Causley ..... B41J 2/17513 101/364
5,138,344 A * 8/1992 Ujita ..... B41J 2/17513 347/14
7,997,703 B2 * 8/2011 Naka ..... B41J 2/17513 347/86
8,011,772 B2 * 9/2011 Kimura ..... B41J 2/16523 347/84
8,162,447 B2 * 4/2012 Kumagai ..... B41J 2/17556 347/65

(Continued)

FOREIGN PATENT DOCUMENTS

JP 2008-265009 A 11/2008

*Primary Examiner* — Stephen Meier
*Assistant Examiner* — John P Zimmerman
(74) *Attorney, Agent, or Firm* — Harness, Dickey & Pierce, P.L.C.

(57) ABSTRACT

A liquid container is configured to be placeable in a containing vessel having a pressurized space and a vessel-side liquid supply structure that is connected with a liquid consuming device. The liquid container comprises a liquid container body; a liquid supply structure that is configured to supply a liquid contained in the liquid container body to the vessel-side liquid supply structure; a container body holding assembly that is configured to hold the liquid container body; and a substrate holding structure that is provided in the container body holding assembly. The container body holding assembly is positioned relative to the containing vessel such that the liquid container body and the liquid supply structure are placed inside of the pressurized space and the substrate holding structure is placed outside of the pressurized space.

10 Claims, 9 Drawing Sheets

(56) References Cited

U.S. PATENT DOCUMENTS

| | | | | |
|---|---|---|---|---|
| 2002/0196312 | A1* | 12/2002 | Ishizawa | B41J 2/175<br>347/50 |
| 2005/0036015 | A1* | 2/2005 | Seino | B41J 2/17553<br>347/86 |
| 2005/0179752 | A1* | 8/2005 | Ishizawa | B41J 2/1752<br>347/86 |

* cited by examiner

LIQUID CONTAINER

CROSS-REFERENCE TO RELATED APPLICATIONS

The present application claims priority from Japanese patent application No. 2015-020013 filed on Feb. 4, 2015, the entirety of disclosure of which is hereby incorporated by reference into this application.

BACKGROUND

Field

The present invention relates to a liquid container that is configured to contain a liquid to be supplied to a liquid consuming device.

Related Art

In a conventional configuration of a liquid ejection device equipped with a liquid ejection assembly configured to eject a liquid such as ink, an ink container (liquid container) is placed inside of a pressurized tank. JP2008-265009A discloses an exemplary configuration of such ink container and pressurized tank. The ink container disclosed in JP2008-265009A is formed in a bag-like shape, is placed on a tray and is inserted into the pressurized tank. An ink outlet provided at an end of the ink container is connected with an ink supply path of a tubular shape placed in the pressurized tank. When the pressurized air is introduced into the pressurized tank in this state, the pressure is applied to the ink container placed in the pressurized space to press the ink contained in the ink container toward the ink supply path and supply the ink to a liquid consuming device.

When ink contained in the ink container configured to supply a liquid such as ink to the liquid consuming device is used up, the ink container is detached from the pressurized tank and is replaced with a new ink container. A substrate that stores information such as contained ink is mounted on this detachable type of ink container. This substrate (circuit board) is electrically connected with a connection terminal on the pressurized tank side in the state that the ink container is placed in the pressurized tank to be ready for ink supply. This enables information to be read out from the substrate and controls the ink supply based on the read-out information.

In the case where the ink container is placed in the pressurized tank, the substrate is likely to be exposed to high-temperature, high-pressure environment in the pressurized tank and to be damaged by water absorption and swelling. Damaging the substrate leads to a failure in stably supplying ink or the like to the liquid consuming device.

SUMMARY

By taking into account the foregoing, an object of the invention is to prevent a substrate mounted on a liquid container that is placed in a pressurized space from being damaged in the pressurized space.

In order to solve the problems described above, according to one aspect of the invention, there is provided a liquid container that is configured to be placeable in a containing vessel having a pressurized space and a vessel-side liquid supply structure that is connected with a liquid consuming device. The liquid container comprises a liquid container body; a liquid supply structure that is configured to supply a liquid contained in the liquid container body to the vessel-side liquid supply structure; a container body holding assembly that is configured to hold the liquid container body; and a substrate holding structure that is provided in the container body holding assembly. The container body holding assembly is positioned relative to the containing vessel such that the liquid container body and the liquid supply structure are placed inside of the pressurized space and the substrate holding structure is placed outside of the pressurized space.

The configuration of the above aspect enables the substrate holding structure of the liquid container to be placed outside of the pressurized space, while the liquid container body of the liquid container is placed inside of the pressurized space. This suppresses a substrate held by the substrate holding structure from being exposed to high-temperature, high-pressure environment in the state that the pressurized air is introduced into the pressurized space to supply the liquid from the liquid container. This accordingly prevents damage of the substrate due to water absorption and swelling.

In the liquid container of the above aspect, the container body holding assembly may be positioned relative to the containing vessel such that the substrate holding structure is placed in a terminal placing structure having an opening that is open in the pressurized space. The substrate holding structure may be arranged to close the opening of the terminal placing structure and seal the terminal placing structure from the pressurized space in a state that the container body holding assembly is positioned relative to the containing vessel. This configuration causes the terminal placing structure of the containing vessel to be sealed from the pressurized space by an operation of positioning the container body holding assembly relative to the containing vessel. This enables the space in which the substrate is placed to be readily made outside of the pressurized space by the simple configuration.

In the liquid container of the above aspect, the substrate holding structure may be provided with a seal member that is configured to prevent leakage of a pressurized fluid from the pressurized space. The seal member is provided to form a space that is sealed from the pressurized space and place the substrate outside of the pressurized space. The seal member is provided on the liquid container that is expendable. Replacement of the liquid container accordingly leads to replacement of the seal member. This suppresses a failure of sealing due to deterioration of the seal member and prevents leakage of a pressurized fluid in the periphery of the substrate holding structure.

In the liquid container of the above aspect, the substrate holding structure may be arranged to hold a circuit board provided with a storage element that stores information with regard to the liquid. This configuration prevents damage of the circuit board and maintains the state that information is readable from the circuit board. This accordingly enables ink or the like to be stably supplied to the liquid consuming device, based on the read-out information.

In the liquid container of the above aspect, the container body holding assembly may have a positioning structure that is configured to position the liquid supply structure and the substrate holding structure relative to the containing vessel. This configuration ensures accurate positioning of the liquid supply structure and the substrate holding structure by means of the positioning structure. This accordingly prevents leakage of the liquid due to a mounting failure and prevents a contact failure of the circuit board.

In the liquid container of the above aspect, the positioning structure may include a plurality of engaged portions that are engaged with a plurality of engagement portions provided on the containing vessel, and at least one of the plurality of engaged portions may be engaged to be movable relative to the engagement portion. Using the plurality of engagement portions and the plurality of engaged portions ensures accurate positioning. There is a certain play between the engagement portion and the engaged portion. This facilitates engagement between the engaged portion and the engagement portion and ensures secure positioning. This accordingly prevents a leakage of the liquid due to a mounting failure and prevents a contact failure of the circuit board. In this aspect, for example, the engaged portion may be provided as a penetrating portion, and the engagement portion may be configured to be engageable with the penetrating portion in a movable manner.

In the liquid container of the above aspect, the container body holding assembly may have an identification element that is provided at a location or in a shape corresponding to the liquid contained in the liquid container body. Positioning the container body holding assembly to the containing vessel accordingly leads to positioning the identification element relative to the containing vessel. The identification element interferes with a structure provided on the containing vessel and thereby effectively prevents the liquid container from being mistakenly mounted.

In the liquid container of the above aspect, the identification element may be arranged away from the substrate holding structure. This configuration suppresses shavings that are produced by hitting the identification element against the structure provided on the containing vessel in the process of mounting the liquid container to the containing vessel, from adhering to contact points or the like on the circuit board and causing a contact failure.

DESCRIPTION OF THE EMBODIMENTS

The following describes an embodiment of a liquid container and a terminal unit thereof which the invention is applied to by referring to accompanied drawings. In the following embodiment, the invention is applied to an ink container (liquid container) that is detachably mounted to an inkjet printer (liquid consuming device). The invention is also applicable to a liquid container that is detachably mounted to a liquid consuming device that is configured to eject a liquid other than ink.

(Liquid Consuming Device)

Figure 1A:
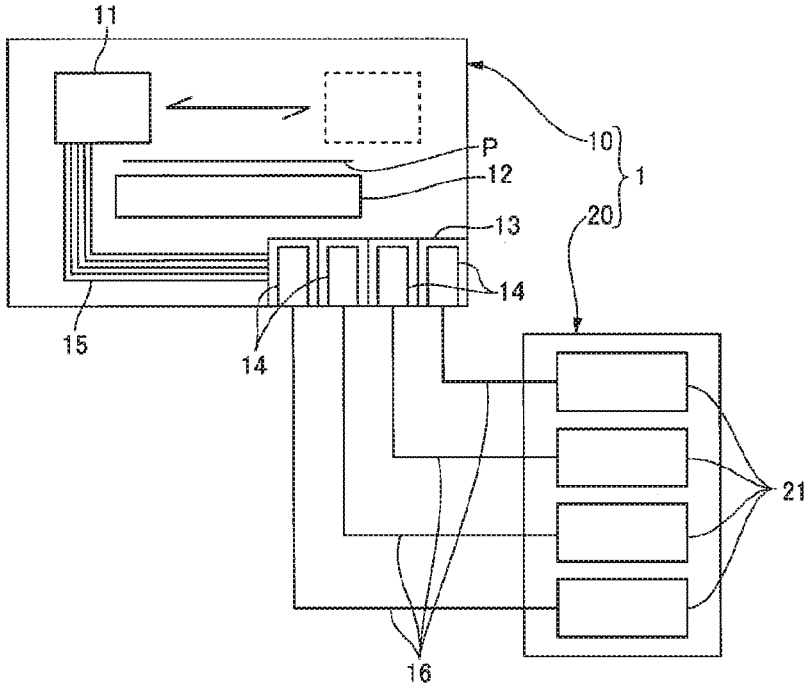
FIG. 1A is a diagram illustrating the genera configuration of an inkjet printer.
Figure 1B:
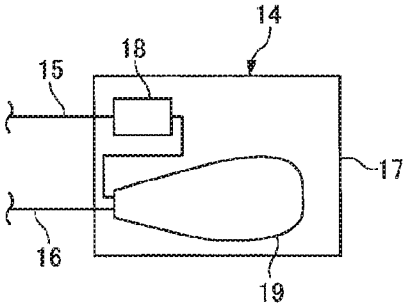
FIG. 1B is a diagram illustrating the configuration of an intermediate tank.

FIGS. 1A and 1B are diagrams schematically illustrating main part of an inkjet printer. FIG. 1A illustrates the genera configuration of the inkjet printer. FIG. 1B illustrates the configuration of an intermediate tank. A printer 1 (liquid consuming device) is an inkjet printer and includes a printer main unit 10 and an ink container unit 20. The printer main unit 10 serves to perform printing on a printing medium P with ink as an example of liquid. The ink container unit 20 serves to store ink that is to be supplied to the printer main unit 10. An inkjet head 11, a platen unit 12, a medium feed mechanism (not shown), a head carriage mechanism (not shown) and the like are provided inside of the printer main unit 10. Printing is performed on the printing medium P by means of the inkjet head 11 when the printing medium P goes through on the platen surface.

The printer main unit 10 includes a cartridge mounting assembly 13. Intermediate tanks 14, each containing a different color ink, i.e., cyan ink C, magenta ink M, yellow ink Y and black ink Bk, are mounted to the cartridge mounting assembly 13. The inkjet head 11 is connected with the respective intermediate tanks 14 by a flexible supply tubes 15. The ink container unit 20 includes the same number of (four in this embodiment) main tanks 21 as the number of the intermediate tanks 14. The respective intermediate tanks 14 are connected with the corresponding main tanks 21 by flexible supply tubes 16. The main tank 21 is pressurized by the compressed air fed from a pressurization unit (not shown) provided in the printer main unit 10. The numbers of the intermediate tanks 14 and the main tanks 21 are not limited to four, and the types of inks contained in these tanks may be different from the four inks described above.

As shown in FIG. 1B, the intermediate tank 14 has a cartridge-type casing 17 and includes a filter 18 and an ink container 19 that are placed inside of the casing 17. The ink container 19 is a flexible tubular container and may be, for example, a resin blow bottle. When the intermediate tank 14 is mounted to the cartridge mounting assembly 13, an ink supply needle is inserted into a connection port provided in the casing 17. This connects the ink container 19 with the supply tube 15 via a filter 18 and also connects the ink container 19 with the supply tube 16. Accordingly, ink stored in the main tank 21 is supplied to and is temporarily reserved in the intermediate tank 14 and is suppliable from the intermediate tank 14 to the inkjet head 11.

(Main Tank)

Figure 2:
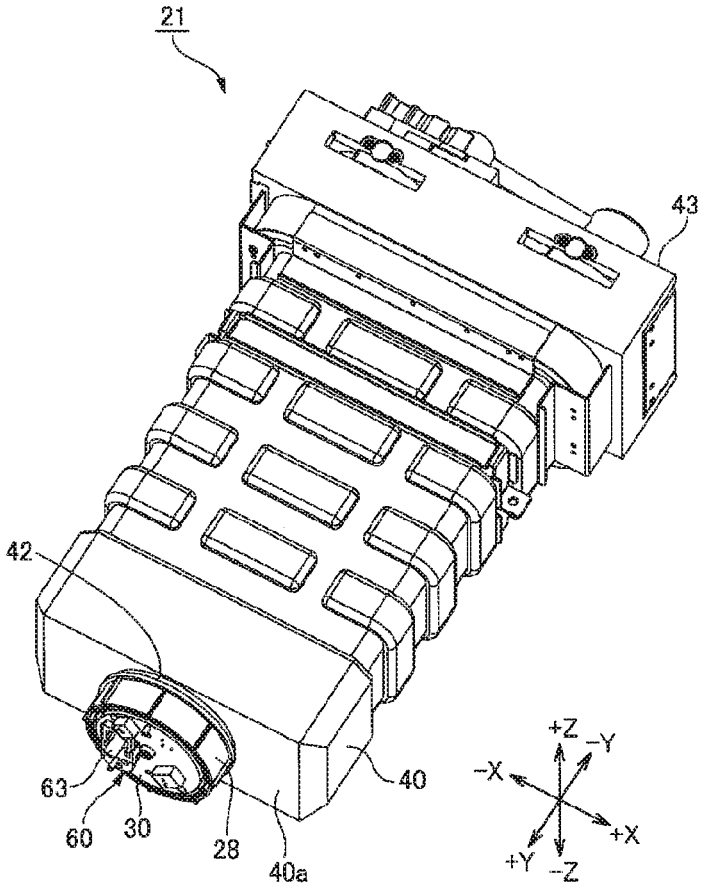
FIG. 2 is an appearance perspective view illustrating a main tank.
Figure 3:
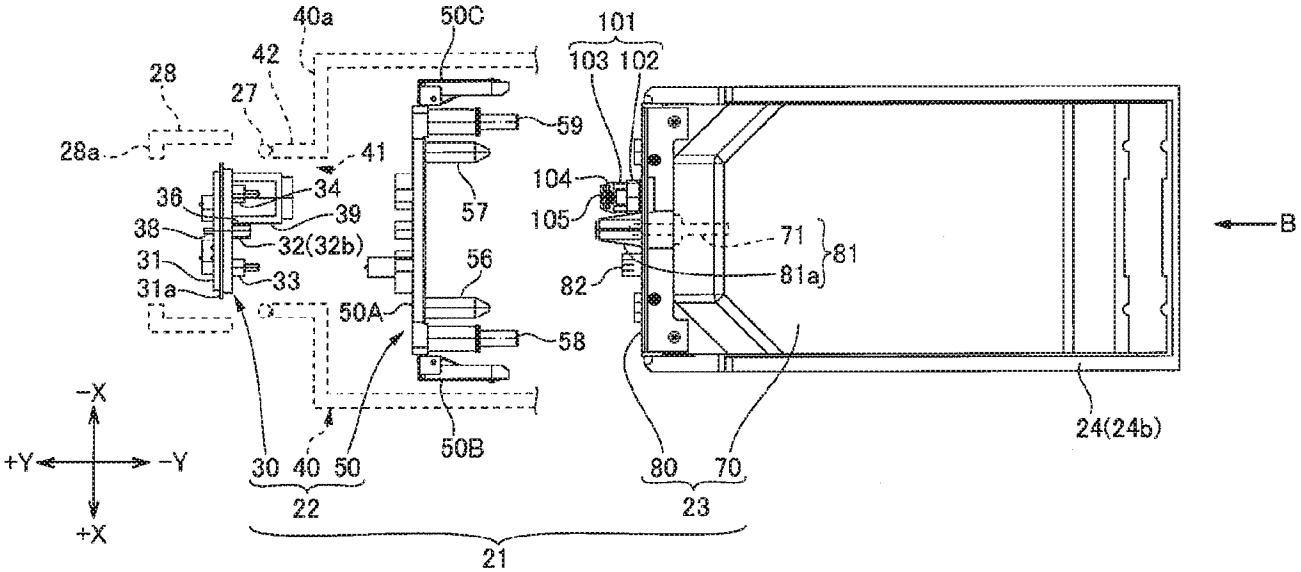
FIG. 3 is an exploded plan view illustrating the main tank.
Figure 4:
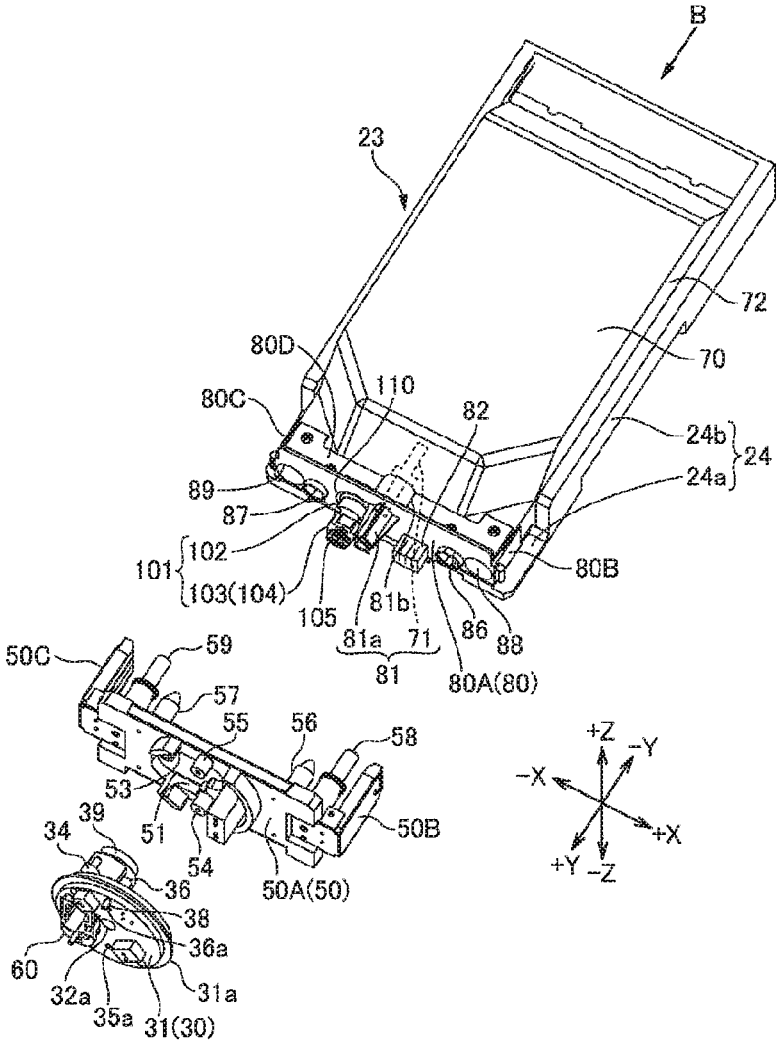
FIG. 4 is an exploded perspective view illustrating the main tank.

FIG. 2 is an appearance perspective view illustrating the main tank 21. FIG. 3 is an exploded plan view illustrating the main tank 21. FIG. 4 is an exploded perspective view illustrating the main tank 21. FIG. 4 illustrates the state that a blow tank is omitted. The main tank 21 includes an ink container placing assembly 22 (containing vessel) provided as a closed vessel, an ink container 23 (liquid container) detachably mounted to inside of the ink container placing assembly 22, and a tray 24 which the ink container 23 is placed on. The ink container placing assembly 22 includes a circular cover member 30, a blow tank 40 and a mounting member 50. The mounting member 50 is placed inside of the blow tank 40 and on a back side of the cover member 30. In the description hereof, three directions orthogonal to one another are defined as container width direction X, container longitudinal direction Y and container vertical direction Z. With regard to the container width direction X, one side and the other side are respectively specified as +X direction side and −X direction side. With regard to the container longitudinal direction Y, one side and the other side are respectively specified as +Y direction side and −Y direction side. With regard to the container vertical direction Z, one side and the other side are respectively specified as +Z direction side and −Z direction side.

The blow tank 40 is a resin vessel in an approximately rectangular parallelepiped shape that is long in the container longitudinal direction Y. The blow tank 40 has a circular opening 41 formed to pass through a container front surface portion 40*a* located on its +Y direction side end (shown in FIG. 3). A cylindrical portion 42 is formed at an opening edge of the circular opening 41 to be protruded toward the +Y direction side. The cover member 30 is mounted to a front end of the cylindrical portion 42 to cover the circular opening 41 and seal the blow tank 40 air-tightly. The cover member 30 includes a cover main body 31 in an approximately disk shape. A flange portion 31*a* is protruded in a ring shape from an outer circumferential end face of the cover main body 31. An outer ring 28 (shown in FIGS. 2 and 3) is mounted to the outer circumferential side of the cylindrical portion 42 and the cover member 30. A ring-shaped portion 28*a* is formed on a +Y direction side end of the outer ring 28 to be extended to the inner circumferential side. When the outer ring 28 is tightened, the ring-shaped portion 28*a* presses the flange portion 31*a* from the +Y direction side. The clearance between the flange portion 31*a* and the cylindrical portion 42 is then sealed with an O ring 27 (shown in FIG. 3).

A rear side opening (not shown) that is open in the -Y direction is formed at the other side end of the blow tank 40 opposite to the circular opening 41, and a door 43 is mounted to open and close this rear side opening. When the door 43 is opened, the ink container 23 and the tray 24 are taken into and out of the blow tank 40 through the rear side opening. When the door 43 is closed, the rear side opening is sealed air-tightly.

Figure 5A:
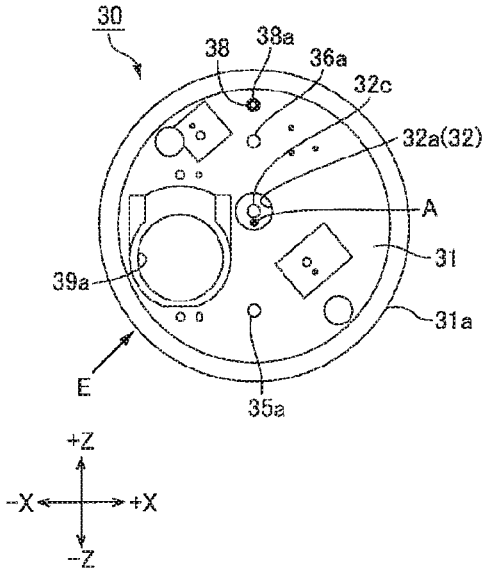
FIG. 5A is a front view illustrating a cover member viewed from a+Y direction side.
Figure 5B:
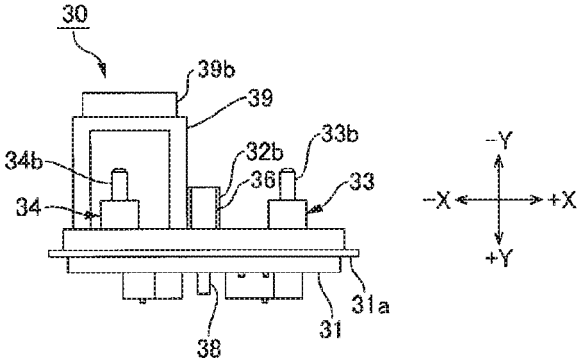
FIG. 5B is a side view illustrating the cover member viewed from a+Z direction side.
Figure 5C:
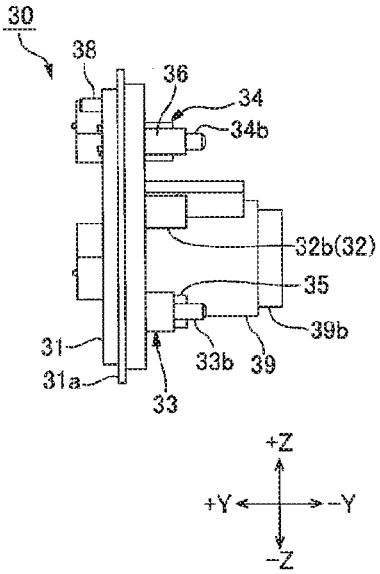
FIG. 5C is a side view illustrating the cover member viewed from a+X direction side.
Figure 6:
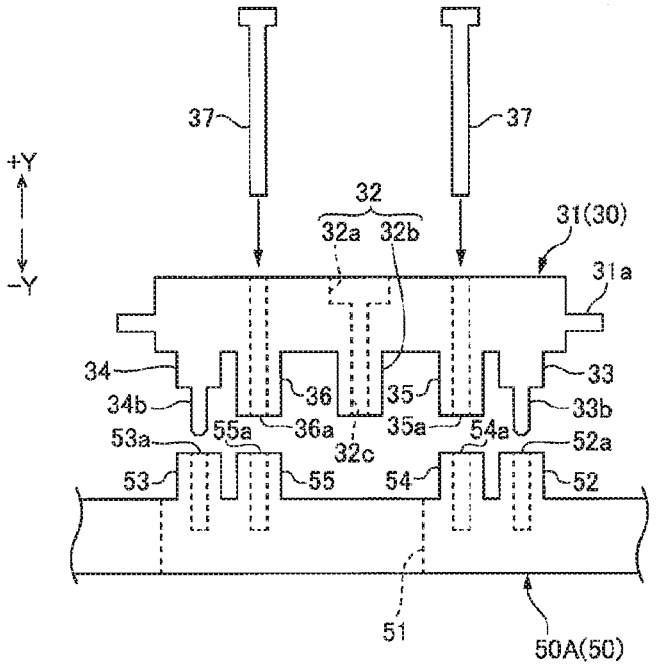
FIG. 6 is a diagram schematically illustrating a fixation structure for fixing the cover member to a mounting member.

FIGS. 5A to 5C are a front view and side views illustrating the cover member 30. FIG. 5A is a front view illustrating the cover member 30 viewed from the +Y direction side. FIG. 5B is a side view illustrating the cover member 30 viewed from the +Z direction side. FIG. 5C is a side view illustrating the cover member 30 viewed from the +X direction side. FIG. 6 is a diagram schematically illustrating a fixation structure for fixing the cover member 30 to the mounting member 50. FIG. 6 is a diagram viewed from the direction of an arrow E in FIG. 5A. FIG. 6 shows the state that the mounting member 50 and the cover member 30 are separated from each other in the container longitudinal direction Y.

The cover member 30 is mounted to the circular opening 41 of the blow tank 40 to be rotatable about a central axis line of the cylindrical portion 42. An ink introducing structure 32 (vessel-side liquid supply structure) is provided at a position slightly deviated from the center of rotation A (shown in FIG. 5A). The ink introducing structure 32 includes a connection port 32*a* that is open to a +Y direction side surface of the cover main body 31 and a protruded portion 32*b* that is protruded in the −Y direction from a back side of the connection port 32*a*. The supply tube 16 that constitutes an ink flow path connecting to the intermediate tank 14 is connected with the connection port 32*a*. An ink supply needle (not shown) is provided at an end of the protruded portion 32*b*. An ink flow path 32*c* is formed inside of the protruded portion 32*b* to make the connection port 32*a* communicate with the ink supply needle.

As shown in FIGS. 3 and 4, the mounting member 50 includes a mounting member main body 50A formed in an approximately rectangular shape that is long in the container width direction X, and end plate portions 50B and 50B provided on the respective ends in the container width direction X of the mounting member main body 50A. The mounting member main body 50A includes a penetrating portion 51 that penetrates in the container longitudinal direction Y. The mounting member 50 and the cover member 30 are placed across the cylindrical portion 42 of the blow tank 40. In this state, the ink supply needle of the ink introducing structure 32 faces the penetrating portion 51 and is opposed to the ink container 23 that is mounted on a back side of the mounting member main body 50A.

The cover member 30 and the mounting member 50 are placed on the respective sides in the container longitudinal direction Y across the cylindrical portion 42 that is provided at the opening edge of the circular opening 41 of the blow tank 40 and are fixed to each other with screws. In the fixing process, as shown in FIG. 6, the mounting member 50 and the cover member 30 are placed close to each other in the container longitudinal direction Y, and small diameter portions 33*b* and 34*b* formed on the respective ends of positioning projections 33 and 34 protruded from the cover main body 31 are respectively inserted into corresponding positioning holes 52*a* and 53*a* of columnar projections 52 and 53 protruded from the mounting member main body 50A. Respective end faces of bosses 54 and 55 protruded from the cover main body 31 are respectively brought into contact with end faces of corresponding bosses 35 and 36 protruded from the mounting member main body 50A. This positions the mounting member 50 relative to the cover member 30.

In the state that the mounting member 50 is positioned relative to the cover member 30, fixation holes 35*a* and 36*a* formed in the bosses 35 and 36 of the cover member 30 are respectively aligned in the container longitudinal direction Y with corresponding fixation holes 54*a* and 55*a* formed in the bosses 54 and 55 of the mounting member main body 50A. In this state, fixation screws 37 are placed in the fixation holes 35*a* and 36*a* from outside of the tank (from the +Y direction side) and are tightened until the respective ends of the fixation screws 37 are screwed to the fixation holes 54*a* and 55*a*. This causes the mounting member 50 screwed and fixed to the cover member 30.

As shown in FIGS. 2 to 5C, the cover member 30 has a pressurized tube connecting structure 38 that is protruded in the +Y direction. A pressurization hole 38*a* is open on an end of the pressurized tube connecting structure 38 (shown in FIGS. 5A to 5C). The pressurized tube connecting structure 38 is connected with a pressurizing module (not shown) of the printer main unit 10 by means of a pressurized tube. The ink container placing assembly 22 internally provides a closed space in the state that both the circular opening 41 and the rear side opening are sealed. The compressed air is fed through the pressurization hole 38*a* into this closed space to pressurize the ink container placing assembly 22.

Figure 10A:
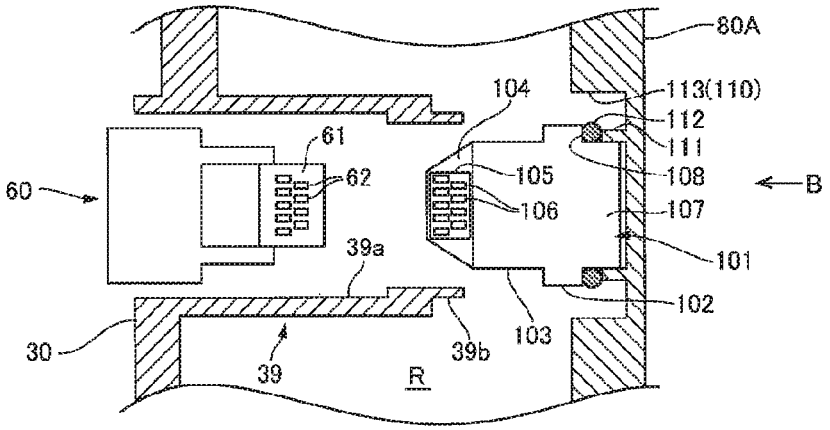
FIG. 10A is a diagram schematically illustrating a terminal array structure and the substrate holding structure.
Figure 10B:
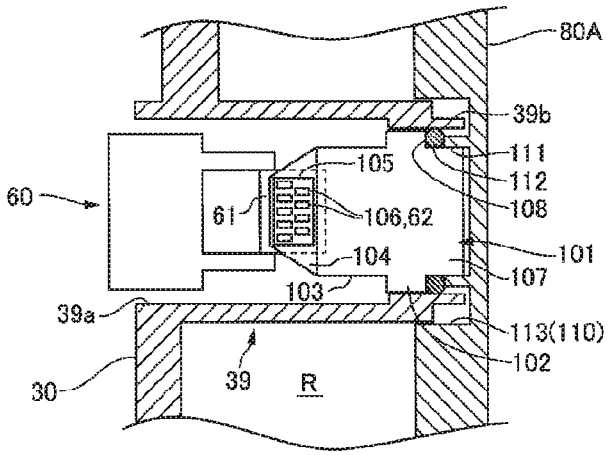
FIG. 10B is a diagram schematically illustrating the terminal array structure and the substrate holding structure.

The inner space of the ink container placing assembly 22 accordingly forms a pressurized space R (shown in FIGS. 10A and 10B). The fixation holes 54*a* and 55*a* and the positioning holes 52*a* and 53*a* used for fixing the mounting member 50 to the cover member 30 are not formed through the mounting member 50. Accordingly, the ink container placing assembly 22 communicates with the outside only through two communication places, i.e., the pressurization hole 38*a* and the ink introducing structure 32.

(Terminal array structure)

As shown in FIGS. 3 to 5C, the cover member 30 has a terminal array structure 39 (terminal placing structure) that is protruded in the −Y direction from the cover main body 31. In the state that the cover member 30 and the mounting member 50 are fixed to each other, the terminal array structure 39 and the ink introducing structure 32 are provided to go through the penetrating portion 51 of the mounting member main body 50A and to be protruded into a cavity which the ink container 23 is placed in. As shown in FIG. 5A, the terminal array structure 39 has a penetrating portion 39*a* that penetrates in the container longitudinal direction Y. The penetrating portion 39*a* has one end that is open to an end face (−Y direction side end face) of the terminal array structure 39 and the other end that is open to a +Y direction side surface of the cover main body 31. As shown in FIGS. 5B and 5C, an end (−Y direction side end) of the terminal array structure 39 forms a tubular portion 39*b* having a smaller diameter than that of the other portion. As described later, a connector unit 60 (shown in FIGS. 2 and 4) is mounted from the +Y direction side to the penetrating portion 39*a*. In the illustrated state of FIGS. 5A to 5C, the connector unit 60 is not mounted to the terminal array structure 39 of the cover member 30. As described later, in the process of mounting the ink container 23, a component of the ink container 23 is inserted into the terminal array structure 39 to close an end of the tubular portion 39*b*. Accordingly, the terminal array structure 39 does not serve as a communication place where the pressurized space R inside of the ink container placing assembly 22 communicates with the outside.

(Ink Container)

Figure 7:
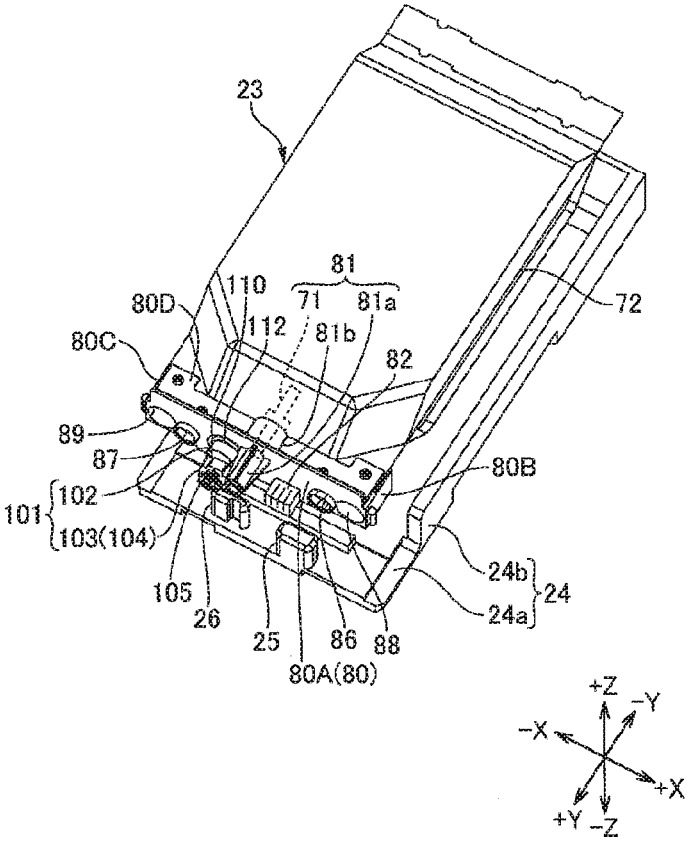
FIG. 7 is a perspective view illustrating the state that an ink container is lifted up from a tray.
Figure 8A:
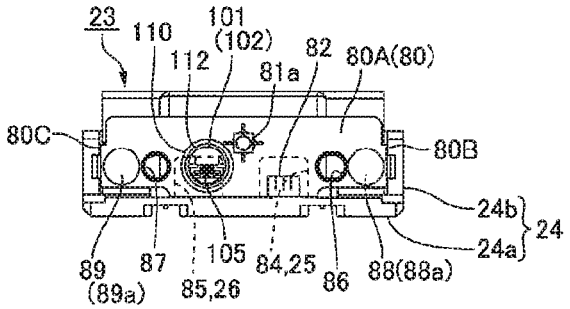
FIG. 8A is a front view illustrating the ink container and the tray.
Figure 8B:
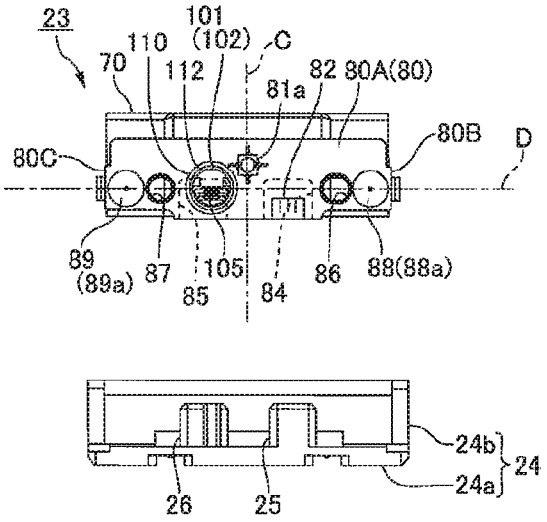
FIG. 8B is a front view illustrating the ink container and the tray.

FIG. 7 is a perspective view illustrating the state that the ink container 23 is lifted up from the tray 24. FIGS. 8A and 8B are front views illustrating the ink container 23 and the tray 24. FIG. 8A illustrates the state that the ink container 23 is placed on the tray 24. FIG. 8B illustrates the state that the ink container 23 is lifted up from the tray 24. The ink container 23 (liquid container) includes an ink pack 70 (liquid container body) that is long in the container longitudinal direction Y and an adaptor 80 (container body holding assembly) mounted to one end in the longitudinal direction of the ink pack 70. The ink pack 70 is a flexible liquid container bag to seal ink inside thereof. An ink supply tube 71 (shown in FIGS. 4 and 7) is welded to the middle of a +Y direction side end of the ink pack 70. Gusset portions 72 are provided on +X direction and −X direction side surfaces of the ink pack 70.

The adaptor 80 includes a front plate member 80A that is long in the container width direction X, end plate members 80B and 80C that are extended in the +Y direction from the respective ends in the container width direction X of the front end member 80A, and an ink pack mounting structure 80D that is provided on a back side (−Y direction side) of the front plate member 80A. The front plate member 80A includes an adaptor front end face that is formed in an approximately rectangular shape and is arranged to face in the +Y direction. A protrusion 81*a* protruded in the +Y direction is formed in the middle in the container width direction X of the front plate member 80A. A convex 81*b* is formed on an upper surface (+Z direction surface) of the ink pack mounting structure 80D and on a back side (−Y direction side) of the protrusion 81*a* to be extended in the container longitudinal direction Y. An end of the ink supply tube 71 protruded from a front end of the ink pack 70 is placed on a back side (−Z direction side) of the convex 81*b* and is fixed to the adaptor 80. The respective ends in the container width direction X of the ink pack mounting structure 80D are engaged with the ink pack 70.

A penetrating portion that penetrates in the container longitudinal direction Y is formed in the protrusion 81*a* protruded from the front plate member 80A. The end of the ink supply tube 71 placed in the convex 81*b* communicates with this penetrating portion. The protrusion 81*a* and the ink supply tube 71 constitute an ink leading structure 81 (liquid supply structure) that is configured to lead ink from the ink pack 70. The ink leading structure 81 is connected with the ink introducing structure 32 of the cover member 30 when the ink container 23 is mounted to the ink container placing assembly 22. When the ink container placing assembly 22 is pressurized in this state, the air pressure squeezes the ink pack 70 to accelerate feed-out of ink from the ink leading structure 81. The ink fed out from the ink leading structure 81 goes through the ink introducing structure 32 and the supply tube 16 to the intermediate tank 14 and is subsequently supplied to the inkjet head 11 from the intermediate tank 14.

The front plate member 80A has a wrong insertion preventing projection 82 (identification element) that is provided on a +X-direction side of the protrusion 81*a* and is protruded in the +Y direction. The ink container placing assembly 22 has a fitting recess (not shown) at a position opposed to the wrong insertion preventing projection 82 in the container longitudinal direction Y. According to this embodiment, the fitting recess is formed on a −Y direction side surface of the mounting member 50. A plurality of grooves are formed in the wrong insertion preventing projection 82. Ribs are formed in the fitting recess at positions corresponding to the grooves of the wrong insertion preventing projection 82. The positions and the number of grooves formed in the wrong insertion preventing projection 82 and the positions and the number of ribs in the fitting recess provided in the ink container placing assembly 22 differ according to the color and the type of ink contained in the ink container 23. In the case of trying to mount the ink container 23 containing a different color or type of ink from the ink that is to be supplied from the ink container placing assembly 22 through the supply tube 16 to the printer main unit 10, the wrong insertion preventing projection 82 interferes with the ribs in the fitting recess and is thus not fit in the fitting recess. This configuration prevents the ink container 23 from being mistakenly mounted. The configuration that the positions and the number of grooves formed in the wrong insertion preventing projection 82 differ according to the color and the type of ink may be replaced by a configuration that the width and the height of the wrong insertion preventing projection 82 differs according to the color and the type of ink. The position where the wrong insertion preventing projection 82 is protruded may also vary according to the color and the type of ink.

As shown in FIGS. 7, 8A and 8B, the tray 24 which the ink container 23 is placed on includes a bottom plate portion 24*a* that is in a rectangular shape and is long in the container longitudinal direction Y and side wall portions 24*b* that are protruded in the +Z direction along three direction edges, i.e., +X direction edge, −Y direction edge and −X direction edge of the bottom plate portion 24*a*. A first fitting element 25 and a second fitting element 26 are formed on a +Y direction side edge of the bottom plate portion 24*a* to be protruded in the +Z direction. When the ink container 23 is placed on the tray 24, the first fitting element 25 of the tray 24 is fit in a first fit element 84 formed in the front plate member 80A of the adaptor 80, and the second fitting element 26 of the tray 24 is fit in a second fit element 85 formed in the front plate member 80A. This positions the ink container 23 relative to the tray 24 in both the container width direction X and the container longitudinal direction Y.

The ink container 23 is taken into and out of the ink container placing assembly 22 in the state that the ink container 23 is placed on the tray 24. The ink container 23 and the tray 24 are inserted from the rear side opening of the ink container placing assembly 22 in such an orientation that the side where the adaptor 80 is located goes first. A mounting direction B in which the ink container 23 is mounted to the ink container placing assembly 22 (shown in FIG. 3) is a direction from the rear side opening toward the cover member 30 and is identical with the +Y direction. The ink container placing assembly 22 is placed in an inclined orientation that the cover member 30-side faces obliquely downward. Accordingly the mounting direction B is obliquely downward direction.

(Substrate Holding Structure and Connector Unit)

As shown in FIGS. 4 and 7, the adaptor 80 (container body holding assembly) includes a substrate holding structure 101 that is protruded in the +Y direction from the front plate member 80A. The front plate member 80A includes a circular recess 110 formed on a −X direction side of the protrusion 81*a*. The substrate holding structure 101 includes a large diameter portion 102 that is protruded in the +Y direction from a bottom of the circular recess 110 and a substrate mounting portion 103 that is further protruded in the +Y direction from the large diameter portion 102. The substrate mounting portion 103 has smaller diameter than that of the large diameter portion 102 and has an inclined surface 104 formed on an end thereof. The inclined surface 104 is inclined in the +Y direction toward the −Z direction. A circuit board 105 mounted to the inclined surface 104 includes terminal portions 106 placed on a surface that faces in the same direction as the inclined surface 104 (shown in FIGS. 10A and 10B). The circuit board 105 is provided with a storage element that is configured to store, for example, the amount of ink in the ink container 23.

The substrate holding structure 101 is opposed in the container longitudinal direction Y to the connector unit 60 that is mounted from the +Y direction side to the penetrating portion 39*a* of the terminal array structure 39 protruded on the back side of the cover member 30 (shown in FIGS. 4 and 5A to 5C). When the ink container 23 is mounted to the ink container placing assembly 22, the substrate holding structure 101 is inserted into the penetrating portion 39*a* of the terminal array structure 39 (shown in FIGS. 5A to 5C) in such an orientation that the circuit board 105 goes first.

Figure 9A:
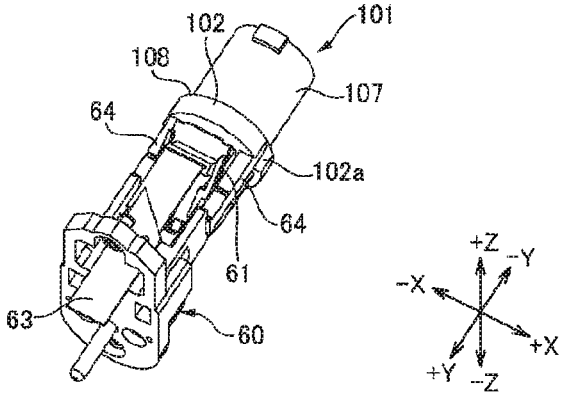
FIG. 9A is a perspective view illustrating a connector unit and a substrate holding structure.
Figure 9B:
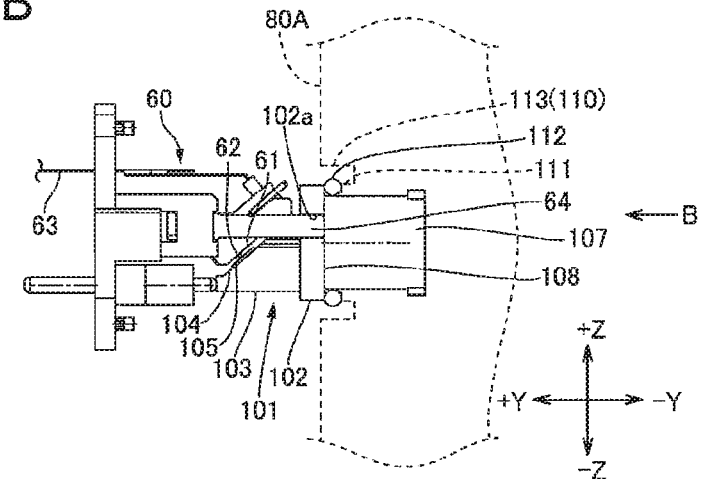
FIG. 9B is a side view illustrating the connector unit and the substrate holding structure.
Figure 9C:
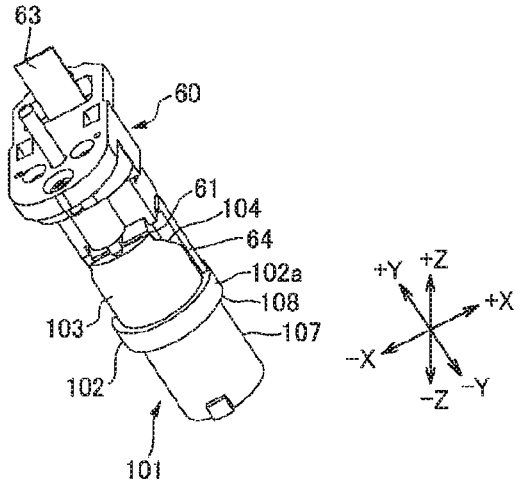
FIG. 9C is a perspective view illustrating the connector unit and the substrate holding structure.

FIGS. 9A to 9C are perspective views and a side view illustrating the connector unit 60 and the substrate holding structure 101. FIGS. 9A and 9C are perspective views from the +Y direction side, and FIG. 9B is a side view from the +X direction side. As shown in FIG. 9B, a ring-shaped projection 111 is formed on a bottom face of the circular recess 110 formed in the front plate member 80A. The substrate holding structure 101 is provided as a separate member from the front plate member 80A. A small diameter portion 107 is formed on a −Y direction end of the substrate holding structure 101 to be fit inside of the ring-shaped projection 111. The small diameter portion 107 is continuous with the large diameter portion 102 in a stepwise manner, and a ring-shaped end face 108 that is arranged to face in the −Y direction is formed between an outer circumferential surface of the small diameter portion 107 and an outer circumferential surface of the large diameter portion 102. An O ring 112 is mounted on a corner portion at which the outer circumferential surface of the small diameter portion 107 is continuous with the ring-shaped end face 108. The O ring 112 is placed between the ring-shaped end face 108 and an end face of the ring-shaped projection 111. The O ring 112 is protruded from an outer circumferential edge of the ring-shaped end face 108 to the outer circumferential side. A clearance is formed between the O ring 112 and an inner circumferential surface 113 of the circular recess 110. According to a modification, the substrate holding structure 101 may be formed integrally with the front plate member 80A, and the O ring 112 may be mounted on the outer circumference of the integrally formed substrate holding structure 101.

The connector unit 60 has an inclined surface 61 that is opposed to the inclined surface 104 of the substrate holding structure 101. The inclined surface 61 is a plane parallel to the inclined surface 104. The inclined surface 61 is placed inside of the penetrating portion 39*a* when the connector unit 60 is mounted to the terminal array structure 39 of the cover member 30. Terminal portions 62 are placed on the inclined surface 61. The terminal portion 62 is one end of a connection terminal that is electrically connected with a wiring 63 drawn from the connector unit 60 toward the front end side of the cover member 30 (shown in FIGS. 2 and 9A to 9C). The wiring 63 is drawn to the printer main unit 10-side, along with the supply tube 16 for ink supply (shown in FIG. 1) and a tube (not shown) connecting with the pressurized tube connecting structure 38.

Grooves 102*a* extended in the container longitudinal direction Y are formed at two positions on the outer circumferential surface of the large diameter portion 102 (shown in FIGS. 9A to 9C). The connector unit 60 has a pair of engagement projections 64 that are protruded in the −Y direction and provided on the respective sides in the container width direction X of the inclined surface 61 which the terminal portions 62 are placed on (shown in FIGS. 9A to 9C). When the substrate holding structure 101 is inserted into the penetrating portion 39*a* of the terminal array structure 39, the respective ends of the engagement projections 64 are inserted into the two grooves 102*a* in the penetrating portion 39*a*. This positions the circuit board 105 (on an XZ plane) relative to the terminal portions 62 provided on the connector unit 60 in the penetrating portion 39*a*.

On completion of mounting the ink container 23 to the ink container placing assembly 22, as shown in FIG. 9B, the terminal portions 106 on the circuit board 105 placed on the inclined surface 104 of the substrate holding structure 101 come into contact with the terminal portions 62 placed on the inclined surface 61 of the connector unit 60. The terminal portions 62 are pressed in a direction outward from the inclined surface 61 and are thereby elastically brought into contact with the terminal portions 106 on the circuit board 105. This connects the circuit board 105 with the terminal portions 62 and allows a controller of the printer 1 to read and write information from and to the circuit board 105.

(Mounting of Ink Container)

As shown in FIGS. 8A and 8B, a first guide hole 86 and a second guide hole 87 are formed in the front plate member 80A of the adaptor 80. The first guide hole 86 and the second guide hole 87 are arranged symmetrically in the container width direction X about a YZ plane going through the center at an end of the protrusion 81*a* of the ink leading structure 81. The first guide hole 86 and the second guide hole 87 are formed through the front plate member 80A in the container longitudinal direction Y. The first guide hole 86 is an oblong hole that is long in the container width direction X. The second guide hole 87 is a true circular hole.

The front plate member 80A of the adaptor 80 also has a first recess 88 formed on the +X-direction side of the first guide hole 86 and has a second recess 89 formed on the -X direction side of the second guide hole 87. The first recess 88 and the second recess 89 are arranged symmetrically in the container width direction X about a line C-C. A straight line D going through the center of a bottom face 88*a* of the first recess 88 and the center of a bottom face 89*a* of the second recess 89 is arranged to be aligned with the first fit element 84 and the second fit element 85 of the adaptor 80 which are fit in the first fitting element 25 and the second fitting element 26 of the tray 24 (shown in FIG. 8B).

As shown in FIGS. 3 and 4, the mounting member 50 is provided with two guide pins 56 and 57 that are protruded in the −Y direction from the mounting member main body 50A. Dampers 58 and 59 are arranged outside of the guide pins 56 and 57 in the container width direction X. The damper 58 is located on the +X direction side of the guide pin 56, and the damper 59 is located on the −X direction side of the guide pin 57.

The ink container 23 is inserted the ink container placing assembly 22 (containing vessel) in such an orientation that the adaptor 80 (container body holding assembly) placed on a leading end thereof is opposed to the mounting member 50 in the container longitudinal direction Y. When the ink container 23 is moved in the mounting direction B (+Y direction) and the adaptor 80 placed on its leading end thereof comes closer to the mounting member 50, insertion of the dampers 58 and 59 into the first and second recesses 88 and 89 starts first. Insertion of the guide pins 56 and 57 into the first and second guide holes 86 and 87 subsequently starts before the respective ends of the dampers 58 and 59 come into contact with the bottom faces 88*a* and 89*a* of the first and second recesses 88 and 89.

The guide pins 56 and 57 are guided via tapered portions formed on respective ends thereof and are respectively inserted into the first and second guide holes 86 and 87 to be engaged with the first and second guide holes 86 and 87. The guide pins 56 and 57 other than their tapered portions are formed in columnar shape having a fixed diameter. The columnar portions of the guide pins 56 and 57 are inserted into the first and second guide holes 86 and 87, so that the adaptor 80 is positioned relative to the mounting member 50 on the XZ plane. The second guide hole 87 formed as the true circular hole serves as the basis for positioning. The other guide hole, i.e., the first guide hole 86, formed as the oblong hole serves as a rotation stop of the adaptor 80 relative to the mounting member 50. Accordingly, the guide pin 56 is engaged with the first guide hole 86 to be movable in the container vertical direction Z. After completion of positioning on the XZ plane by means of the guide pins 56 and 57 and the first and second guide holes 86 and 87, the respective ends of the dampers 58 and 58 come into contact with the bottom faces 88*a* and 89*a* of the first and second recesses 88 and 89 (shown in FIGS. 8A and 8B).

The dampers 58 and 59 are air dampers that are extendable in the container longitudinal direction Y. As shown in FIGS. 3 and 4, the dampers 58 and 59 have protruded portions that are protruded in the −Y direction from the mounting member main body 50A, and pistons are inserted from respective ends of the dampers 58 and 59. The piston is placed to seal one end of a concave cavity formed inside of the protruded portion. After end faces of the pistons in the dampers 58 and 59 come into contact with the bottom faces 88*a* and 89*a* of the first and second recesses 88 and 89, the pistons work to compress the air in the concave cavities with further move of the ink container 23 in the mounting direction B (i.e., in the +Y direction). This produces a damping force in the dampers 58 and 59 against an inertial force of the ink container 23 moving in the mounting direction B. Accordingly, after the dampers 58 and 59 come into contact with the bottom faces 88*a* and 89*a* of the first and second recesses 88 and 89, the damping function reduces the impact force applied to the place where the ink container placing assembly 22 and the ink container 23 hit against each other.

When the guide pins 56 and 57 are engaged with the first and second guide holes 86 and 87 to position the mounting member 50 relative to the adaptor 80 on the XZ plane, the ink leading structure 81 of the ink container 23 is placed to be opposed in the container longitudinal direction Y to the ink introducing structure 32 of the ink container placing assembly 22. The ink leading structure 81 is connected with the ink introducing structure 32 after the guide pins 56 and 57 are engaged with the first and second guide holes 86 and 87 and compression of the dampers 58 and 59 is started to activate the damping function. A seal member (not shown) pressed in the +Y direction by a spring seat is provided on an end of the ink leading structure 81. In the state that the ink leading structure 81 is disconnected from the ink introducing structure 32, the seal member seals the ink leading structure 81 to stop the outflow of ink. When the ink leading structure 81 is connected with the ink introducing structure 32, the ink supply needle presses and moves the seal member in the −Y direction. As a result, this makes a flow path in the ink leading structure 81 communicate with a flow path in the ink introducing structure 32.

FIGS. 10A and 10B are diagrams schematically illustrating the terminal array structure 39 and the substrate holding structure 101. FIG. 10A illustrates the state that mounting of the ink container 23 is not yet completed. FIG. 10B illustrates the state that mounting of the ink container 23 is completed. In parallel with the inserting operation of inserting the guide pins 56 and 57 into the first and second guide holes 86 and 87, an inserting operation is performed to insert the substrate holding structure 101 into the penetrating portion 39*a* of the terminal array structure 39. FIG. 10A illustrates the position of insertion of the substrate holding structure 101 when the pistons in the dampers 58 and 59 come into contact with the bottom faces 88*a* and 89*a* of the first and second recesses 88 and 89 to start activating the damping function. When the ink container 23 is further moved in the mounting direction B (+Y direction) from this state, the engagement projections 64 provided on the connector unit 60 are inserted into the grooves 102*a* formed in the large diameter portion 102 of the substrate holding structure 101, so that the circuit board 105 and the terminal portions 62 are positioned relative to each other as described above. In parallel with this positioning operation, an inserting operation is performed to insert the tubular portion 39*b* formed on an end of the terminal array structure 39 into a space between the large diameter portion 102 of the substrate holding structure 101 and the inner circumferential surface 113 of the circular recess 110. As a result, this provides a state that the O ring 112 is fit in the clearance between an inner circumferential surface of the tubular portion 39*b* and the small diameter portion 107.

The tubular portion 39*b* of the terminal array structure 39 comes into contact with the O ring 112 at a timing after the ink leading structure 81 is connected with the ink introducing structure 32 as described above. As shown in FIG. 10B, when the tubular portion 39*b* is inserted to the outer circumference of the O ring 112, the O ring 112 works to seal the clearance between the tubular portion 39*b* and the small diameter portion 107. As a result, this blocks communication between the penetrating portion 39*a* and the pressurized space R in the ink container placing assembly 22 and makes the penetrating portion 39*a* outside of the pressurized space R. The terminal portions 106 on the circuit board 105 are brought into contact with the terminal portions 62 of the connector unit 60 in the mounting direction B at a timing after the tubular portion 39*b* comes into contact with the O ring 112 and the penetrating portion 39*a* is made outside of the pressurized space R. In the state that mounting of the ink container 23 is completed, as shown in FIG. 10B, the substrate holding structure 101 and the connector unit 60 are placed in a space sealed from the pressurized space R in the ink container 23.

The terminal portions 106 on the circuit board 105 and the terminal portions 62 of the connector unit 60 are respectively provided on the inclined surface 104 and on the inclined surface 61 that are inclined to the mounting direction B. Accordingly, the terminal portions 62 slide along the surface of the circuit board 105 to come into contact with the terminal portions 106 on the circuit board 105. This sliding operation removes extraneous substances and the like adhering to the surface of the circuit board 105. This suppresses a contact failure between the terminal portions 106 and the terminal portions 62 due to the extraneous substances and the like adhering to the terminal portions 106.

As described above, the ink container 23 is mounted to the ink container placing assembly 22 through the following steps (1) to (6):

(1) positioning the ink container 23 relative to the tray 24 by means of the fitting elements at two locations;

(2) positioning the ink container 23 relative to the mounting member 50 by means of the two guide pins 56 and 57;

(3) activating the damping function by the dampers 58 and 59;

(4) connecting the ink introducing structure 32 with the ink leading structure 81;

(5) sealing the penetrating portion 39*a* of the terminal array structure 39 from the pressurized space R; and (6) bringing the terminal portions 106 on the circuit board 105 into contact with the terminal portions 62 of the connector unit 60.

(Functions and Advantageous Effects)

As described above, according to this embodiment, the ink container placing assembly 22 is provided as a pressurized vessel, and the ink pack 70 of the ink container 23 is placed in the pressurized space R. The ink container 23 has the adaptor 80 that is provided to hold the ink pack 70. The adaptor 80 includes the ink leading structure 81 that is configured to communicate with the ink pack 70 and the substrate holding structure 101 that is configured to hold the circuit board 105. When the ink container 23 is mounted to the ink container placing assembly 22, the adaptor 80 is positioned relative to the mounting structure 50 fastened in the ink container placing assembly 22. In this positioning state, the ink leading structure 81 is placed in the pressurized space R and is connected with the ink introducing structure 32 provided in the cover member 30 of the ink container placing assembly 22. The substrate holding structure 101 is, on the other hand, inserted into the terminal array structure 39 provided in the cover member 30, and the terminal array structure 39 is closed at the opening thereof by the substrate holding structure 101 and is made outside of the pressurized space R. In other words, in the state that the ink container 23 is mounted to the ink container placing assembly 22, the substrate holding structure 101 is placed outside of the pressurized space R, while the ink pack 70 is placed in the pressurized space R. This suppresses the circuit board 105 held by the substrate holding structure 101 from being exposed to high-temperature, high-pressure environment in the state that the compressed air is introduced into the pressurized space R to supply ink from the ink container 23. Accordingly this prevents damage of the circuit board 105 due to water absorption and swelling and maintains the state that information is readable from the circuit board 105. Ink is thus stably suppliable to the printer main body 10-side, based on the read-out information.

According to this embodiment, the substrate holding structure 101 is inserted into the terminal array structure 39 of the ink container placing assembly 22 in the course of mounting the ink container 23. On completion of mounting, the substrate holding structure 101 is placed to close the opening of the terminal array structure 39 and thereby seal the terminal array structure 39 from the pressurized space R. This enables the terminal array structure 39 to be readily closed and made outside of the pressurized space R by the simple configuration. The terminal array structure 39 of the embodiment is provided as a tubular component having the penetrating portion 39*a* formed therein but may be provided in a different configuration, for example, as a recess that is open in the pressurized space R.

According to this embodiment, the substrate holding structure 101 is provided with the O ring 112 that comes into contact with the end of the terminal array structure 39. This prevents leakage of the pressurized fluid from the pressurized space R. In the configuration that the O ring 112 is mounted to the component (substrate holding structure 101) of the ink container 23 that is expendable, replacement of the ink container 23 leads to replacement of the O ring 112. This suppresses a failure of sealing due to deterioration of the O ring 112 and prevents leakage of the pressurized fluid in the periphery of the substrate holding structure 101.

According to this embodiment, the mounting member 50 of the ink container placing assembly 22 has the guide pins 56 and 57 (engagement portions), and the adaptor 80 of the ink container 23 has the first and second guide holes 86 and 87 (positioning structure/engaged portions/penetrating portions) that are engaged with the guide pins 56 and 57. These structural elements enable the ink leading structure 81 provided on the adaptor 80 and the substrate holding structure 101 to be accurately positioned relative to each other. This accordingly prevents leakage of the liquid due to a connection failure of the ink leading structure 81 and prevents a contact failure between terminals. The guide pin 57 is engaged with the second guide hole 87 formed as the true circular hole, while the other guide pin 56 is engaged with the first guide hole 86 formed as the oblong hole to be movable in the container width direction X. This configuration facilitates engagement of the guide pins with the guide holes and performs positioning by using the plurality of guide pins. This ensures secure positioning.

According to this embodiment, the adaptor 80 of the ink container 23 is provided with the wrong insertion preventing projection 82 that is formed in a configuration that differs according to the color and the type of ink contained in the ink container 23. Positioning the adaptor 80 relative to the ink container placing assembly 22 accordingly causes the wrong insertion preventing projection 82 to be positioned relative to the ink container placing assembly 22. The configuration (for example, fitting recess) corresponding to the wrong insertion preventing projection 82 provided on the ink container placing assembly 22-side effectively prevents the ink container 23 containing a wrong color or type of ink from being mistakenly mounted. Additionally, according to this embodiment, the wrong insertion preventing projection 82 is placed on the +X-direction side of the ink leading structure 81 and is away from the substrate holding structure 101. This suppresses shavings that are produced by hitting the wrong insertion preventing projection 82 against the structure on the ink container placing assembly 22-side, from adhering to the circuit board 105 and causing a contact failure between the terminal portions 106 and the terminal portions 62.

What is claimed is:

1. A liquid container that is configured to be detachable from a pressurized space formed in a containing vessel having the pressurized space and a vessel-side liquid supply structure that is connected with a liquid consuming device, the liquid container comprising:

a liquid container body;

a liquid supply structure that is configured to supply a liquid contained in the liquid container body to the vessel-side liquid supply structure;

a container body holding assembly that is configured to hold the liquid container body; and a substrate holding structure that is provided in the container body holding assembly, wherein the container body holding assembly is positioned relative to the containing vessel such that the liquid container body and the liquid supply structure are disposed inside of the pressurized space and the substrate holding structure is disposed outside of the pressurized space while the substrate holding structure is detachably attached to the containing vessel.

2. The liquid container according to claim 1, wherein the container body holding assembly is positioned relative to the containing vessel such that the substrate holding structure is placed in a terminal placing structure having an opening that is open in the pressurized space, and the substrate holding structure is arranged to close the opening of the terminal placing structure and seal the terminal placing structure from the pressurized space in a state that the container body holding assembly is positioned relative to the containing vessel.

3. The liquid container according to claim 2, wherein the substrate holding structure is provided with a seal member that is configured to prevent leakage of a pressurized fluid from the pressurized space.

4. The liquid container according to claim 1, wherein the substrate holding structure is arranged to hold a circuit board provided with a storage element that stores information with regard to the liquid.

5. The liquid container according to claim 1, wherein the container body holding assembly has a positioning structure that is configured to position the liquid supply structure and the substrate holding structure relative to the containing vessel.

6. The liquid container according to claim 5, wherein the positioning structure includes a plurality of engaged portions that are engaged with a plurality of engagement portions provided on the containing vessel, and at least one of the plurality of engaged portions is engaged to be movable relative to the engagement portion.

7. The liquid container according to claim 6, wherein the engaged portion is provided as a penetrating portion.

8. The liquid container according to claim 1, wherein the container body holding assembly has an identification element that is provided at a location or in a shape corresponding to the liquid contained in the liquid container body.

9. The liquid container according to claim 8, wherein the identification element is arranged away from the substrate holding structure.

10. The liquid container according to claim 1, wherein the substrate holding structure protrudes from the container body holding assembly in a mounting direction in which the liquid container is mounted to the containing vessel, and has an inclined surface formed on an end thereof.

* * * * *